US005458336A

United States Patent [19]

Miller

[11] Patent Number: 5,458,336

[45] Date of Patent: Oct. 17, 1995

[54] GOLF PRACTICE AID

[76] Inventor: Omer Miller, 416 Wildwood Dunes Trail, Myrtle Beach, S.C. 29572

[21] Appl. No.: 318,244

[22] Filed: Oct. 5, 1994

[51] Int. Cl.[6] ..... A63B 69/36

[52] U.S. Cl. ..... 273/186.1; 273/200 R

[58] Field of Search ..... 273/185 D, 186.1, 273/187.1, 187.6, 196, 200 R

[56] References Cited

U.S. PATENT DOCUMENTS

| | | | |
|---|---|---|---|
| 1,999,518 | 4/1935 | Stafford | 273/185 D |
| 3,622,161 | 11/1971 | Keppen | 273/195 R X |
| 4,023,811 | 5/1977 | DeCota | 273/186.1 |
| 4,928,966 | 5/1990 | Miller | 273/195 A |
| 5,028,052 | 7/1991 | Miller | 273/195 R |
| 5,340,109 | 8/1994 | Miller | 273/186.1 |

FOREIGN PATENT DOCUMENTS 2039465 of 1980 United Kingdom .

2095564 of 1981 United Kingdom .

*Primary Examiner*—George J. Marlo
*Attorney, Agent, or Firm*—Bacon & Thomas

[57] ABSTRACT

A golf practice aid is disclosed which will provide a visual indication of the path of the club head during a golf swing. The golf practice aid has a base which is stationarily located on a support surface and to which is pivotally attached a friction surface assembly. A golf club head contacts the friction surface during a portion of the golfer's swing or stroke, which will cause pivoting movement of the friction surface assembly relative to the base should the path of travel of a club head not be aligned with the intended path of travel. An improper swing or stroke will cause the friction surface assembly to pivot about its attachment to the base. The friction surface assembly remains in a displaced position after the swing or stroke, enabling the golfer to view the golf aid and quickly ascertain any defects in the path of travel of the club head.

14 Claims, 7 Drawing Sheets

GOLF PRACTICE AID

BACKGROUND OF THE INVENTION

The present invention relates to a practice aid for golfers, more particularly a golf stroke and swing aid which is capable of pivoting to visually indicate the path of travel of the golf club during a practice stroke or swing.

The intricacies of the game of golf are such that a golfer is required to put in innumerable hours of practice in order to attain and maintain a desired level of proficiency. One of the important factors in improving one's golf game is the path of the club head as it strikes the golf ball. Failure to consistently swing the golf club such that the club head travels along the desired path will impart undesired movement to the golf ball.

Although moving the club along the proper path is extremely important to establishing and maintaining a consistent golf game, as a practical matter, it is one of the most difficult elements of the game to practice properly. In fact, it is virtually impossible for a golfer to observe and analyze the path of club head travel during his stroke or swing without resorting to professional instruction, or expensive and complicated video taping systems. Many golfers are simply unable to afford the time of a professional instructor, nor can they afford the expense of complex video taping systems.

Practice golf mats are known which simulate the feel of actual turf and which may include movable portions to avoid inducing severe shocks to the golfer caused by contact between the club head and the golf mat. In such known golf mats, the movable portion will typically move only in one direction and will automatically return to its initial position after the contact between the club head and the golf mat. Such golf mats provide no indication to the golfer of the path of his/her swing, since they automatically return to their initial positions before the golfer can view the golf mat.

SUMMARY OF THE INVENTION

A golf practice aid is disclosed which will provide a visual indication of the path of the club head during a golf swing. The golf practice aid has a base which is stationarily located on a support surface and to which is pivotally attached a friction surface assembly.

Once the pivoting golf aid is properly located, the club head contacts the friction surface during a portion of the golfer's swing or stroke, which will cause pivoting movement of the friction surface assembly relative to the base should the path of travel of a club head not be aligned with the intended path of travel of the golf ball. Thus, inside-out, or outside-in movement of the club head will cause the friction surface to pivot about its attachment to the base. The friction surface assembly remains in a displaced position after the swing or stroke, enabling the golfer to view the golf aid and quickly ascertain any defects in the path of travel of the club head.

To assist a golfer in his evaluation, visual indicia may be included on the base and the friction surface assembly so as to be readily viewed by the golfer after his swing.

DETAILED DESCRIPTION OF THE PREFERRED EMBODIMENT

Figure 1:
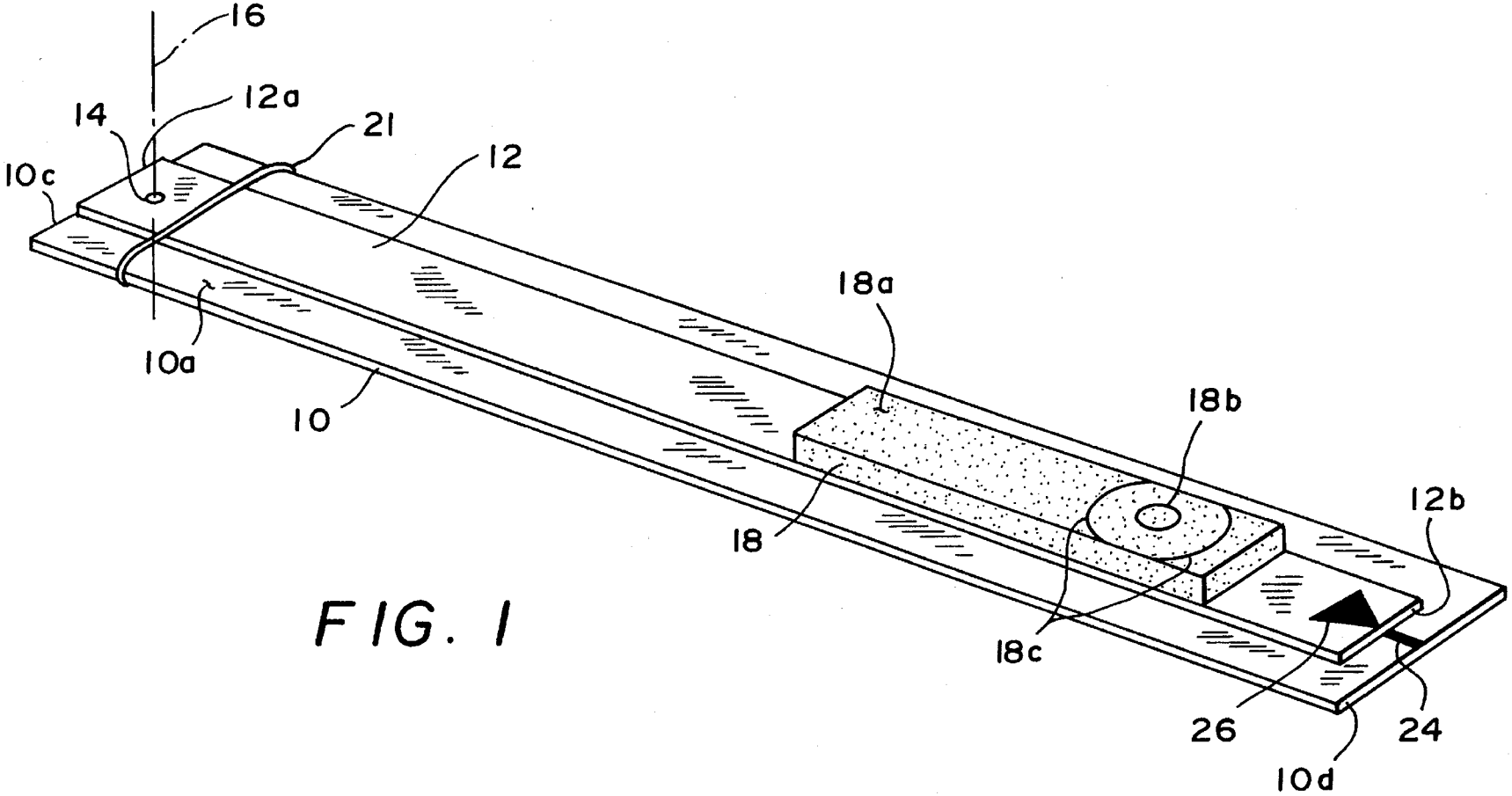
FIG. 1 is a perspective view of the golf practice aid according to the present invention.
Figure 3:
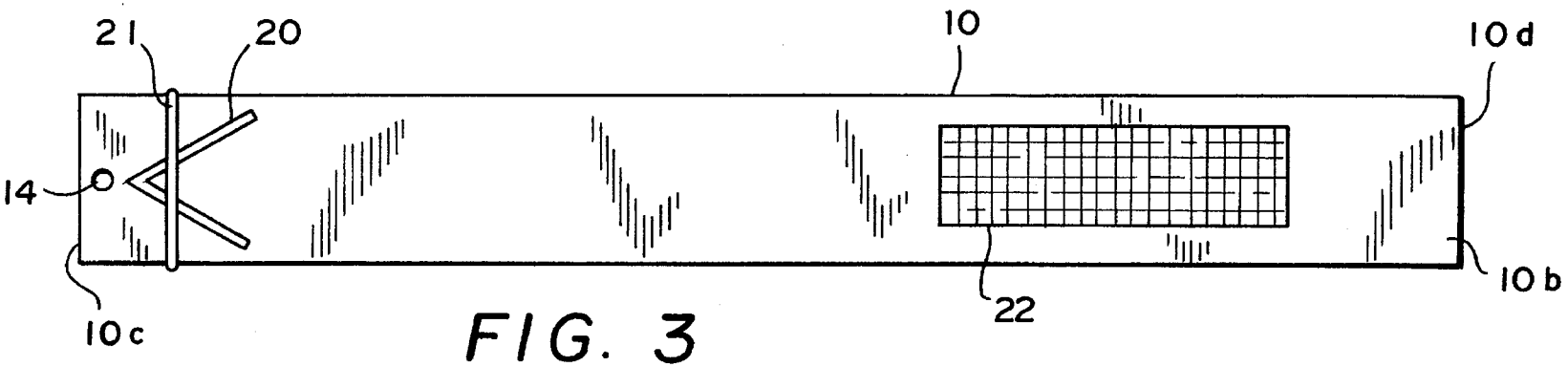
FIG. 3 is a bottom view of the golf practice aid illustrated in FIG. 1.

As best seen in FIG. 1, the golf practice aid device according to the present invention comprises a base 10 having an elongated configuration with an upper surface **10*a* and a bottom surface 10*b* (see FIG. 3). The base may be formed from a relatively thin sheet of plastic material which may be somewhat flexible. Pivotally attached to base 10 adjacent to an end portion 10*c*, is attaching member 12 having an end portion 12*a* that is pivotally attached to the base 10 via pivot attachment 14. Attaching member 12 is pivotally attached to base 10 such that it may pivot relative thereto about axis 16 which extends generally perpendicular to the plane of the base 10**.

Affixed to an upper surface of the attaching member 12 is a layer of material 18 which has friction surface **18*a* facing upwardly from the attaching member 12. Material 18 may comprise a known type of foam, suede or other material having a friction surface and may be affixed to the attaching member 12 via any known attaching means, such as adhesive, tape, etc. The friction surface 18*a* defines an indentation 18*b* and may also define a partial outline 18*c* approximately the size of a golf ball enclosing the indentation 18*b*** which generally designates the center of a golf ball.

A patch or layer of non-skid material 22 is fixedly attached to the bottom surface **10*b* of the base 10, as illustrated in FIG. 3. The non-skid material 22 may be of any known material and is fixedly attached to the surface 10*b* by any known means. Arc marker 20 is movably attached to the bottom surface 10*b* of the base 10 by band 21 or the like. Arc marker 20 raises the ends 10*c* and 12*a* of the golf practice aid when it is placed on a support surface. By raising these ends, a slightly concave curvature is imparted to the attaching member 12 and the layer of friction material 18. This concave curvature is in the form of an arc and may be used to determine the proper arc of the club head during a practice stroke or swing. Although arc marker 20 is shown as having a generally "V"-shape, quite obviously other shapes may be utilized without exceeding the scope of this invention. The position of the arc-marker 20 on the base 10 may be varied so that the user can tailor the arc or curvature of the friction material and attaching member to suit his/her particular stroke. Moving the arc-marker towards end 10*d* will decrease the radius of the arc, while moving it in the opposite direction will increase the radius of the arc. Once the proper location of arc-marker 20 has been determined by a particular golfer, any contact between the club head and the friction surface 18**a as the club head is drawn back during the backswing or stroke will indicate an improper arc to the swing or stroke.

Upper surface 10*a* adjacent to an end 10d opposite that of end 10*c* of base 10 has visual indicia 24 located thereon, as does the attaching member 12 at end portion 12*b*, opposite end portion 12*a*. In this particular instance, the visual indicia comprises a line 24 on upper surface 10*a* of the base 10 and arrow 26 on an upper surface of the attaching member 12. Quite obviously, the indicia may be in reversed positions, or other indicia may be utilized to indicate the specific alignment between the attaching member 12 and the base 10, without exceeding the scope of this invention. The end 12*b* may itself be shaped in the form of an arrow or pointer.

Figure 4:
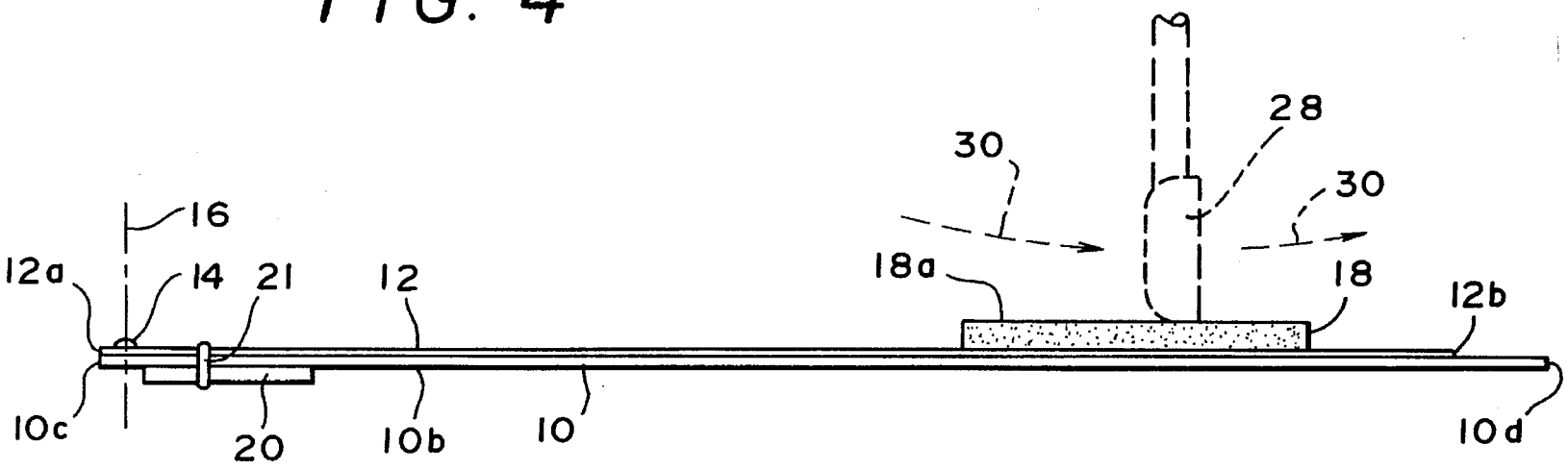
FIG. 4 is a side view of the golf practice aid illustrated in FIG. 1.

In use, the device is placed on a supporting surface, which may be indoors or outdoors enabling the golfer to practice his/her stroke or swing in any location. The non-skid patch or layer 22 will bear on the support surface and keep the base 10 from slipping or sliding along the support surface as the friction surface 18*a* is contacted by the golf club. Once the device has been placed on a support surface, the golfer is positioned adjacent to one or the other of the sides of the device such that the golf club head will contact the friction surfaces at the ball position, illustrated by lines 18*c* and indentation 18*b*. As the golfer draws the club back and then forward in the golf swing or stroke, the golf club head 28 will move in an arc, generally designated by arrows 30 in FIG. 4, such that the lower portion of the club head 28 will contact the friction surface 18*a*.

Figure 2:
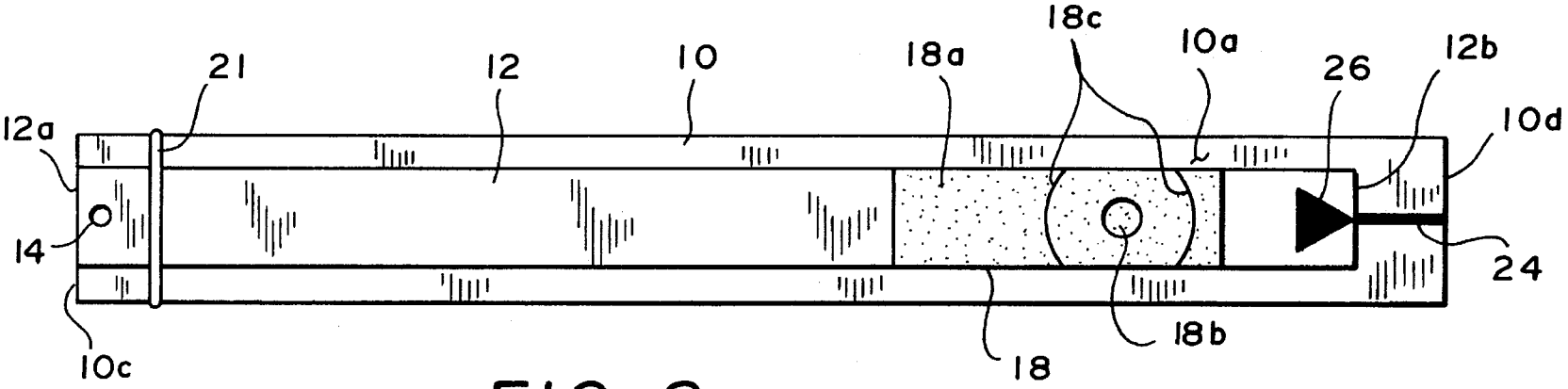
FIG. 2 is a top view of the golf practice aid illustrated in FIG. 1.

The golf practice aid according to the present invention provides the golfer with a visual indication that the plane of the path of travel of the golf club head 28 is in the desired direction. Initially, the attaching member 12 is positioned such that the arrow 26 is in alignment with the line 24 on the base 10, as illustrated in FIGS. 1 and 2, and wherein the line 24 points in the direction of the desired club head travel. Under actual playing conditions, any deviation of the club head from this desired path of travel will cause a ball to move in an undesired direction.

Figure 5:
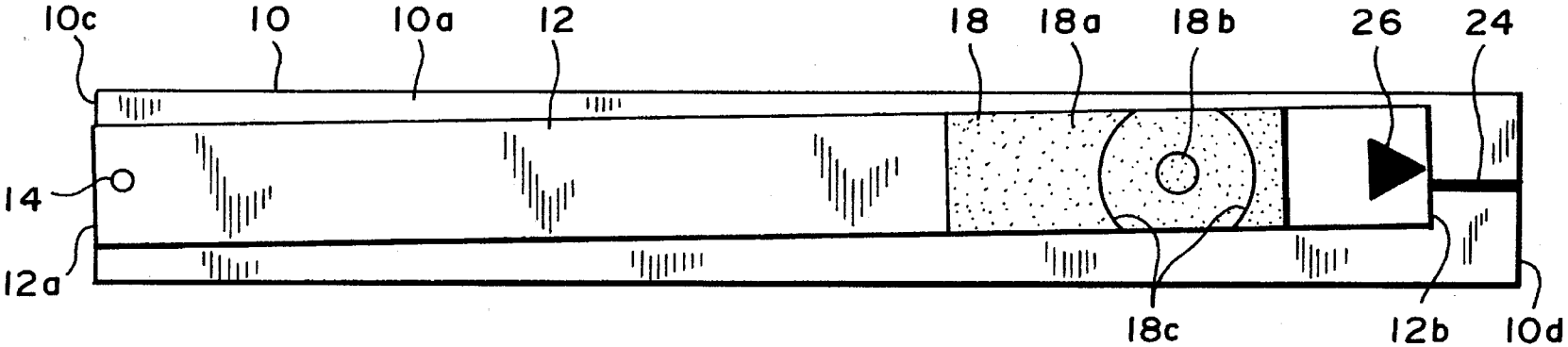
FIGS. 5 and 6 are top views of the golf aid according to the present invention with the friction surface assembly skewed in opposite directions which is indicative of an improper golf swing.
Figure 6:
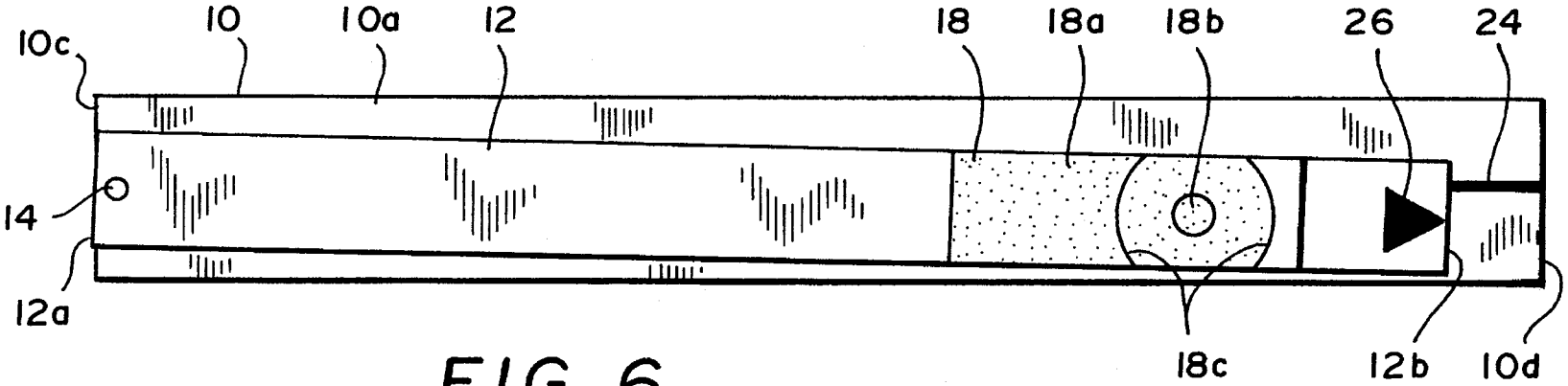

As illustrated in FIGS. 5 and 6, contact between the bottom of the club head 28 and the friction surface 18*a* during the golf swing or stroke will exert sufficient force on the layer 18 and the attaching member 12 to cause them to pivot with respect to the base 10 about pivot point 14. Following the completion of the practice swing or stroke, the golfer may visually examine the relative positions of the arrow 26 and line 24 to ascertain if his/her golf swing or stroke was in the proper direction. FIG. 5 illustrates the final positions of the attaching member 12 and the layer 18 when the plane of the golf swing is out of alignment with line 24 in one direction, while FIG. 6 illustrates the positions of the elements when the plane of the golf swing was out of alignment in an opposite direction with respect to line 24.

Thus, as can be seen, the golf practice aid according to the present invention enables a golfer to practice proper golf swings and strokes, and will provide an indication should either the arc or the plane of the golf swing or stroke deviate from the desired arc or direction.

After practicing the swing or stroke without the presence of the golf ball, once the golfer has achieved a desired level of proficiency, it is also possible to practice the golf swing using the device according the invention incorporating a golf ball placed on the friction surface 18*a*. A golf ball may be placed such that it rests in the indentation 18*b* and the golfer may continue to practice utilizing the golf ball.

Figure 7:
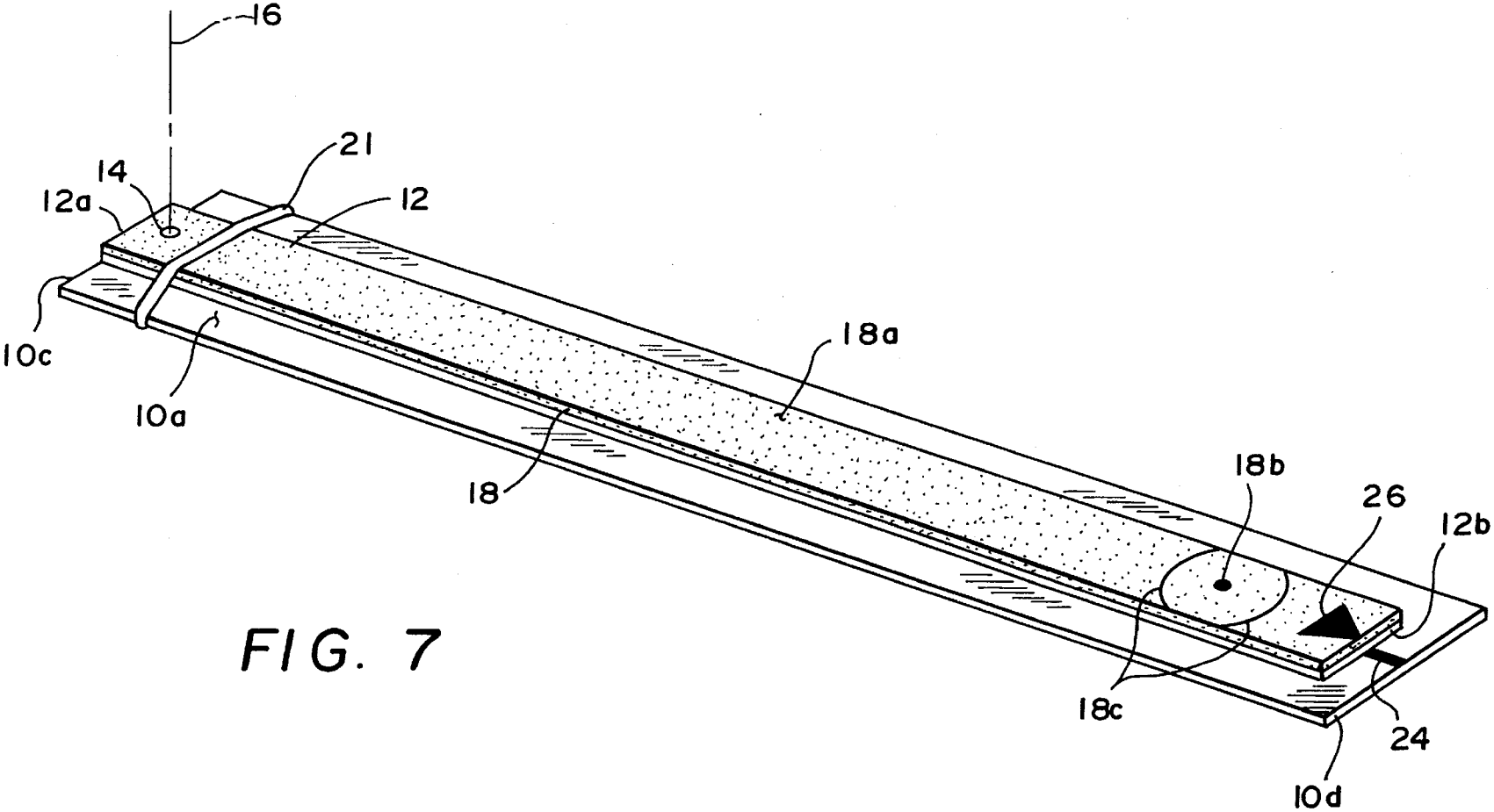
FIG. 7 is a perspective view of an alternative embodiment of the golf practice aid according to the present invention.
Figure 8:
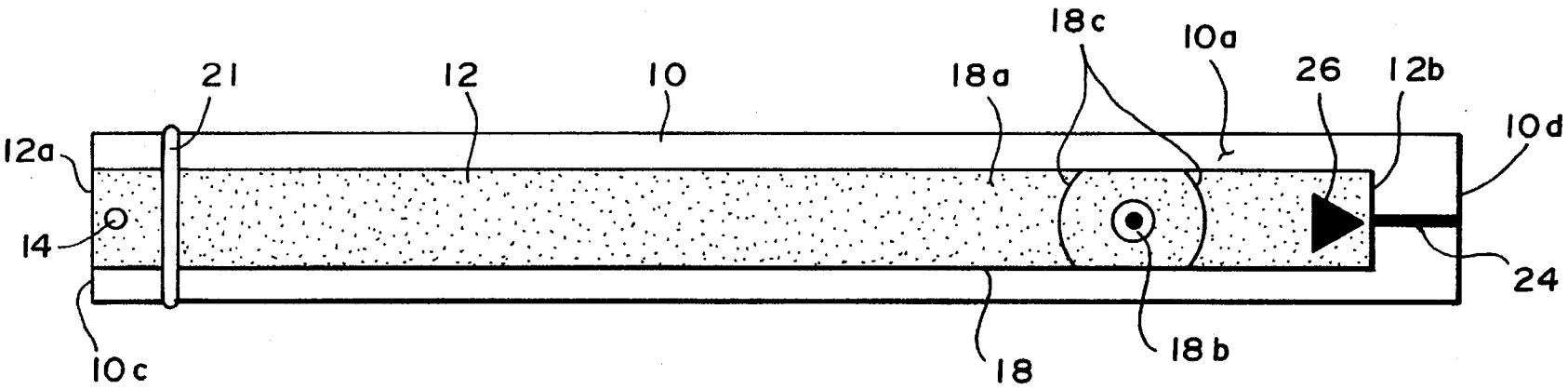
FIG. 8 is a top view of the embodiment illustrated in FIG. 7.

FIGS. 7 and 8 disclose an alternative embodiment in which the friction material 18 extends substantially along the entire length of the elongated attaching member 12. As in the previously described embodiment, the friction surface 18*a* also defines an indentation 18*b* which denotes a center of a golf ball, illustrated by outline 18*c*. The indicia 26 may be imprinted on the upper surface 18*a* of the friction material 18 or, the end 12*b* of the attaching member and the adjacent end of the friction material 18 may be formed in the shape of an arrow or pointer. This embodiment functions in exactly the same fashion as the previously described embodiment whereby the contact between the golf club head and the friction surface 18*a* will cause the attaching member 12 and the friction material 18 to pivot about axis 16 should the plane of the swing or stroke of the golf club not be aligned with indicia 24 on the base 10. As previously noted, the friction material may comprise a known foam or suede material.

Figure 10:
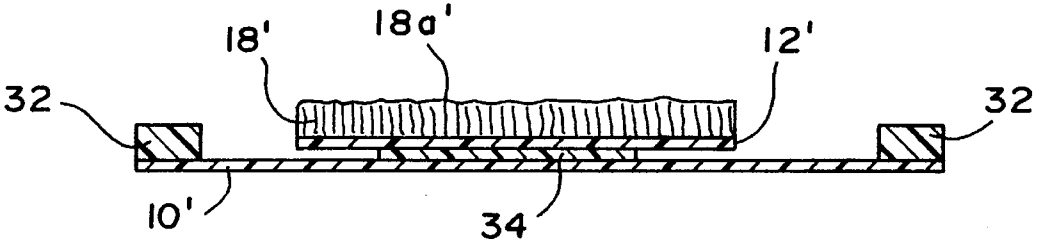
FIG. 10 is a cross-sectional view taken along line X—X in FIG. 9.
Figure 9:
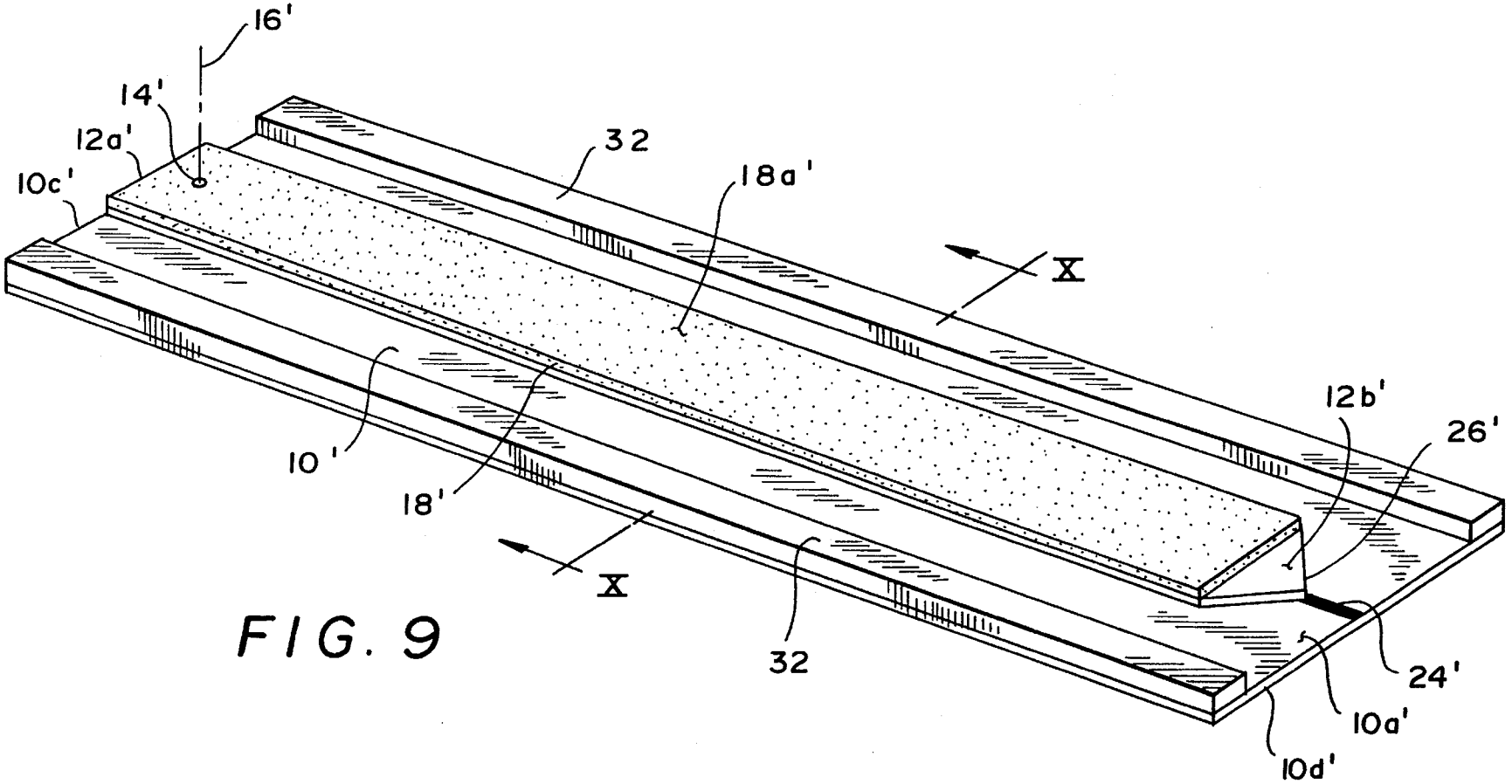
FIG. 9 is a perspective view of a third embodiment of the golf practice aid according to the present invention.

The previously described embodiments find particular usage in practicing golf putting strokes, although the principles of this invention may also accommodate a golf swing. This embodiment is illustrated in FIGS. 9 and 10 wherein it can be seen that the base 10' is formed of an elongated plastic, flexible material and has attaching member 12' attached thereto by elosstic pivot connection 14' such that the attaching member 12' may pivot with respect to the base 10' about axis 16', which extends generally perpendicular to the axis 16'. A layer of friction material 18' is attached to the upper surface of the attaching member 12' such that friction surface 18*a'* faces upwardly. Although not illustrated in the figures, the friction surface 18*a'* may also have the indentation and golf ball outlines as in the previously described embodiment. In this particular instance, the end 12*b'* of the attaching member 12' is formed in the shape of an arrow 26'. Indicia 24', in this particular instance a line, is located on an upper surface 10*a'* of the base member 10'. The friction material 18' may comprise a carpet layer typically used on golf mats.

The golf swing practice aid of this embodiment may be physically larger than the putting aid as in the previously described embodiments. In order to provide sufficient rigidity to the base 10', side reinforcing members 32 are attached to the upper surface 10*a'* and extend substantially along the length of the base 10' adjacent to the opposite lateral edges. The side reinforcing members 32 may be fabricated from wood, plastic, or other material and may be affixed to the base 10' by known means such as adhesive bonding, etc.

To minimize the friction between the bottom of the attaching member 12' and the upper surface 10*a'* of the base 10, a strip 34 of plastic having reduced frictional characteristics is attached to the base 10' and bears upon the lower surface of the attaching member 12', as illustrated in FIG. 10. The strip 34 may be formed of Lexan, or other materials having reduced friction characteristics. Similarly, attaching members 12 and 12' may also be formed of Lexan.

In operation, the friction contact between the club head (not shown) and the friction surface 18*a'* will cause the friction layer 18' and the attaching member 12' to pivot about axis 16' with respect to the base 10' should the plane of the golf swing not be aligned with line 24'. This can be easily ascertained by the golfer by visually inspecting the device after the golf swing and checking the relative positions between indicia 26' and 24'.

The foregoing description is provided for illustrative purposes only and should not be construed as in any way limiting this invention, the scope of which is defined solely by the appended claims.

I claim:

1. A golf aid to provide a visual indication of the path of a club head during a golfers swing or stroke comprising:

a) an elongated base;

b) an elongated attaching member having a generally planar friction surface thereon configured to contact the club head during a portion of the golfers swing or stroke; and, c) attaching means to pivotally attach the elongated attaching member to the elongated base such that the elongated attaching member may pivot with respect to the elongated base whereby contact between the club head and the friction surface will cause the elongated attaching member to align itself with the path of travel of the club head during the swing.

2. The golf aid of claim 1 further comprising visual indicia located on at least one of the elongated base and the elongated attaching member to visually indicate relative pivoting movement between the elongated base and the elongated attaching member.

3. The golf aid of claim 2 wherein the visual indicia comprises:

a) a first visual indicia located on the elongated base; and, b) a second visual indicia located on the elongated attaching member.

4. The golf aid of claim 6 wherein at least one of the first and second visual indicia comprises a line.

5. The golf aid of claim 6 wherein at least one of the first and second visual indicia comprises an arrow.

6. The golf aid of claim 2 wherein the visual indicia comprises:

a) a line on the elongated base; and, b) an arrow on the elongated attaching member.

7. The golf aid of claim 1 wherein the friction surface comprises a layer of foam material.

8. The golf aid of claim 1 wherein the friction surface comprises a layer of suede material.

9. The golf aid of claim 1 wherein the elongated base has a bottom surface and further comprising a non-skid element located on the bottom surface.

10. The golf aid of claim 1 further comprising an indentation defined by the friction surface.

11. The golf aid of claim 1 further comprising an outline of a golf ball located on the friction surface.

12. The golf aid of claim 11 further comprising an indentation defined by the friction surface within the outline of the golf ball to denote the center thereof.

13. The golf aid of claim 1 wherein the elongated base and the elongated attaching member are formed of flexible material and the elongated base has a bottom surface, and further comprising an arc-marker located on and extending from the bottom surface of the base so as to impart a curvature to the friction surface when the elongated base is placed on a support surface.

14. The golf aid of claim 13 wherein the arc-marker is movably attached to the elongated base.

* * * * *